United States Patent [19]

Eckert, Jr. et al.

[11] 4,287,825

[45] Sep. 8, 1981

[54] PRINTING CONTROL SYSTEM

[75] Inventors: Alton B. Eckert, Jr., Norwalk; Richard A. Malin, Westport; Robert B. McFiggans, Stamford; Leonard M. Pengue, Huntington, all of Conn.

[73] Assignee: Pitney Bowes Inc., Stamford, Conn.

[21] Appl. No.: 89,412

[22] Filed: Oct. 30, 1979

[51] Int. Cl.[3] ..... B41J 1/22

[52] U.S. Cl. ..... 101/91; 101/45

[58] Field of Search ..... 101/45, 56, 91, 92, 101/235

[56] References Cited

U.S. PATENT DOCUMENTS

| | | | |
|---|---|---|---|
| 3,405,634 | 10/1968 | Maul et al. | 101/45 |
| 3,776,130 | 12/1973 | Tamiya | 101/45 |
| 3,823,666 | 7/1974 | Hanson | 101/91 |
| 3,881,411 | 5/1975 | Araki et al. | 101/45 |
| 3,965,815 | 6/1976 | Lupkas et al. | 101/91 |
| 3,983,802 | 10/1976 | Thomson et al. | 101/45 |
| 4,050,374 | 9/1977 | Check | 101/91 |
| 4,056,054 | 11/1977 | Feldman | 101/45 |
| 4,140,054 | 2/1979 | Martin et al. | 101/91 |

*Primary Examiner*—Edward M. Coven

*Attorney, Agent, or Firm*—David E. Pitchenik; Wm. D. Soltow, Jr.; Albert W. Scribner

[57] ABSTRACT

A printing control system includes a printing mechanism having settable print members. A gear is rotatably mounted and operably connected for selectively setting the print members. The gear is connected to control inhibiting the printing mechanism from being energized to print. The gear may also be connected to control inhibiting the selective setting of the print members.

8 Claims, 6 Drawing Figures

PRINTING CONTROL SYSTEM

FIELD OF THE INVENTION

The present invention relates to printing control systems and more particularly to printing control systems suitable for use in postage meters.

BACKGROUND OF THE INVENTION

Electronic postage meters have been developed with electronic accounting circuitry. Postage meter systems of this type are disclosed in U.S. Pat. No. 3,978,457 for Microcomputerized Electronic Postage Meter System and in U.S. Pat. No. 3,938,095 for Computer Responsive Postage Meter. The electronic accounting circuits include memory capability for storing postage accounting information. The memory function in the electronic accounting circuits have replaced the function served in postage meters by mechanical accounting registers.

Postage meters with mechanical accounting registers are not subject to many of the problems encountered by electronic postage meters. Conditions cannot normally occur in postage meters with mechanical registers that prevent accounting for a printing cycle or which result in the loss of data stored in the registers. Thus, dependent reliable control of the postage printing mechanism operation is desirable in electronic postage meters. It is also desirable in systems of this type that the printing mechanism be controlled in a manner which inhibits printing postage if the system is not operating properly.

Postage meter printing systems suitable for use with electronic postage meters, such as those disclosed in U.S. Pat. No. 3,965,851 for Setting Mechanism for a Postage Printing Device and U.S. Pat. No. 4,050,374 for Meter Setting Mechanism, include a printing drum with a set of adjacent print wheels each of which carriers print characters. Each print wheel is set for example, to position different postage amounts for printing, by an independently rotatable gear mechanism adapted to be engaged by a master gear. The master gear is rotatably mounted within a laterally movable carriage. The carriage can be moved to cause successive engagement with each independently rotatable gear mechanism. The printing drum is energized to rotate to print postage by a drive gear within the meter. Meter printing systems of this type are detachably mounted on a drive base. When so mounted, the postage meter drive gear meshes with a drive gear in the base. One suitable drive base is disclosed in U.S. Pat. No. 2,934,009 for Sheet Feeding and Treating.

Postage meter printing systems may incorporate a shutter bar movably mounted within the meter. The shutter bar is movable into and out of a blocking position which inhibits energization of the postage meter drive gear. When the meter is mounted on the base, the shutter bar is mechanically connected to a shutter bar lever on the base which drives the shutter bar to move into and out of the blocking position. A clutch is provided in the base and is operated by the shutter bar lever. The clutch is arranged to prevent the base drive gear from rotating unless the shutter bar lever is in a position which corresponds to the shutter bar being moved out of the blocking position. This insures that if the base is tripped to drive the postage meter drive gear, the base drive gear will rotate only if the shutter bar has been moved by the shutter bar lever out of its blocking position.

The postage setting meter printing systems of the above type may also incorporate interposers which prevent the shutter bar from being moved out of its blocking position by the drive base shutter bar lever. The interposers may be operated to lock the shutter bar in the blocking position and thereby inhibit energization of the meter drive gear when the postage meter is not properly conditioned to print postage. For example, in U.S. Pat. No. 4,050,374 for Meter Setting Mechanism, the shutter bar is blocked by a camming extension on the master gear carriage or yoke when the carriage is shifted to any position other than an enable position. These arrangements are satisfactory and properly perform their intended purpose.

SUMMARY OF THE INVENTION

The present invention provides improved control over the print character selecting and printing functions. This provides increased assurance that the meter is properly functioning when printing occurs. The invention provides flexibility in controlling the meter printing mechanisms to prevent improper setting or printing. Further, the invention also provides a system which is particularly suited for postage meters, especially electronic postage meters, where added protection against the improper postage amount setting and the improper postage printing is especially desirable.

A printing control system embodying the present invention includes means for printing. The printing means includes settable print members and is adapted to be energized by a source of operating energy to print. Energizing means are operably connected to the printing means for energizing the printing means to print. Printing inhibiting means are coupled to the energizing means. The printing inhibiting means inhibits the energizing means from being operable to energize the print means to print. Setting means including a rotatably mounted gear are operably connected to the printing means for selectively setting the print members. Actuating means are controlled by the setting means gear. The actuating means are connected to the print inhibiting means for actuating the printing inhibiting means to inhibit the energizing means from being operable to energize the printing means to print.

In accordance with a feature of the present invention, setting inhibiting means may be provided. The setting inhibiting means are coupled to the setting means for inhibiting the setting means from being operable to set the print members. The actuating means are connected to the setting inhibiting means. The actuating means, under control of the setting means gear, actuates the setting inhibiting means to inhibit the setting means from being operable to set the print members.

DESCRIPTION OF THE DRAWINGS

A complete understanding of the present invention may be obtained from the following detailed description thereof when taken in conjunction with the accompanying drawings, in which.

DETAILED DESCRIPTION OF THE INVENTION

Figure 1:
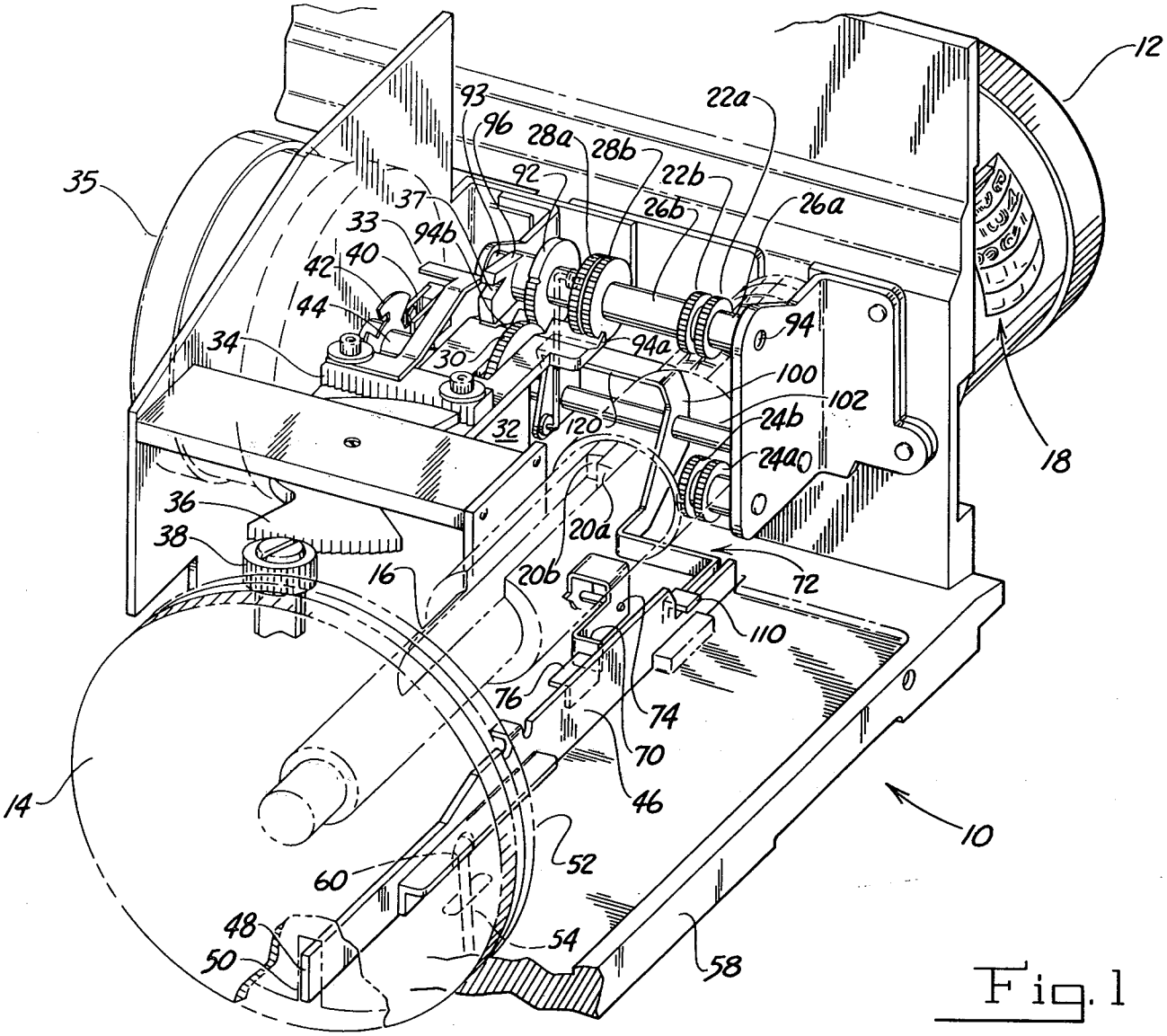
FIG. 1 is a perspective view, partially broken away, of a postage meter embodying the present invention.

Reference is now made to the several figures wherein like reference numerals designate similar components in the various views. A postage meter 10 includes a rotatable drum 12 which is energized to rotate by a postage meter drive gear 14 connected to the stepped drum shaft 16. The postage meter is enclosed in a secure tamper resistant housing, not shown, to provide physical security. The printing drum includes a plurality of settable print wheels 18. The print wheels are settable to move different print characters into position for printing on a mail piece when print drum 12 is energized to rotate. The print wheels may be similar to those disclosed in U.S. Pat. No. 2,829,591 for Postage Printing Die Protection. Each print wheel is controlled to be set by a rack such as rack 20*a* which is in operative engagement with rack gear 22*a* and rack 20*b* which is in operative engagement with rack gear 22*b*. Additional racks, not shown, are controlled by lower rack gears 24*a* and 24*b*. The rack gears 22*a*, 22*b*, 24*a* and 24*b*, when rotated, position their respective racks to slide within the stepped drum shaft 16 to set associated print wheels to a desired print character for printing.

The rack gears 22*a* and 22*b* are mounted for rotation with concentric shafts 26*a* and 26*b*. Laterally spaced gears 28*a* and 28*b* are mounted on the concentric shafts. Rotation of gear 28*a* rotates shaft 26*a* thereby causing the rotation of gear 22*a* to move its cooperating rack 20*a* to position the associated print wheel. Gear 28*b* cooperates in a similar manner with shaft 22*b*, gear 22*b* and rack 20*b*. It should be recognized that lower rack gears 24*a* and 24*b* operate in a similar manner with corresponding components, not shown.

A master gear 30 is rotatably mounted within a laterally movable carriage 32. Master gear 30 is driven to rotate by stepper motor 35. Lateral movement of the carriage 32 is effecuated by rack 34 and butterfly gear 36. Butterfly gear 36 is driven through a gear 38 connected to a stepper motor, not shown. The stepper motor 35, as well as the stepper motor controlling the gear 38, allow master gear 30 and slidable carriage 32 to be accurately positioned. The position of the master gear, when rotated, is sensed by optical detector 40 cooperating with slotted disc 42 mounted on the master gear drive shaft 44. Detector 40 is a two channel LED-photodetector combination, and in conjunction with disc 42, functions as a conventional quadrature encoder. By counting the number and sequence of transitions of the encoder, the position of the master gear can be confirmed. Other optical detectors and slotted discs may be provided throughout the mechanism to provide information concerning the position of various components during operation of the postage meter. The stepper motors may be controlled in accordance with the systems disclosed in U.S. Pat. No. 3,978,457 for Microcomputerized Electronic Postage Meter System or U.S. patent application entitled Electronic Postage Meter Having Plural Computing Systems, filed concurrently herewith for John Soderberg, Alton Eckert and Robert McFiggans, Ser. No. 089,413.

When not inhibited against movement, as will hereinafter be described in detail, slidable carriage 32 may be laterally moved to operatively engage a selected laterally spaced gear such as gears 28*a* and 28*b*. The master gear 30 may thereafter be rotatably driven by stepper motor 35 to in turn drive the engaged gear to rotate and operate the associated print wheel setting mechanism. The stepper motor 35 may be of conventional design, such as the stepper motors manufactured by North American Philips Control Corporation, model A82783. Motors of this type have the same step angle tolerance in degrees when rotated through any number of steps. Thus, to achieve greater accuracy in setting the motor shaft, it may be desireable to rotate the motor shaft through more than one step. As an example, the model A82783 stepper motor has a $\pm 0.5°$ tolerance in the step angle regardless of the number of steps through which the stepper motor shaft is rotated. Since each step is seven and one-half degrees of shaft rotation, there are 48 step positions in a complete 360° shaft revolution. By employing several steps between each operative position for the postage meter stepper motors, the percentage of error per rotation to an operating position is diminished.

Figure 2:
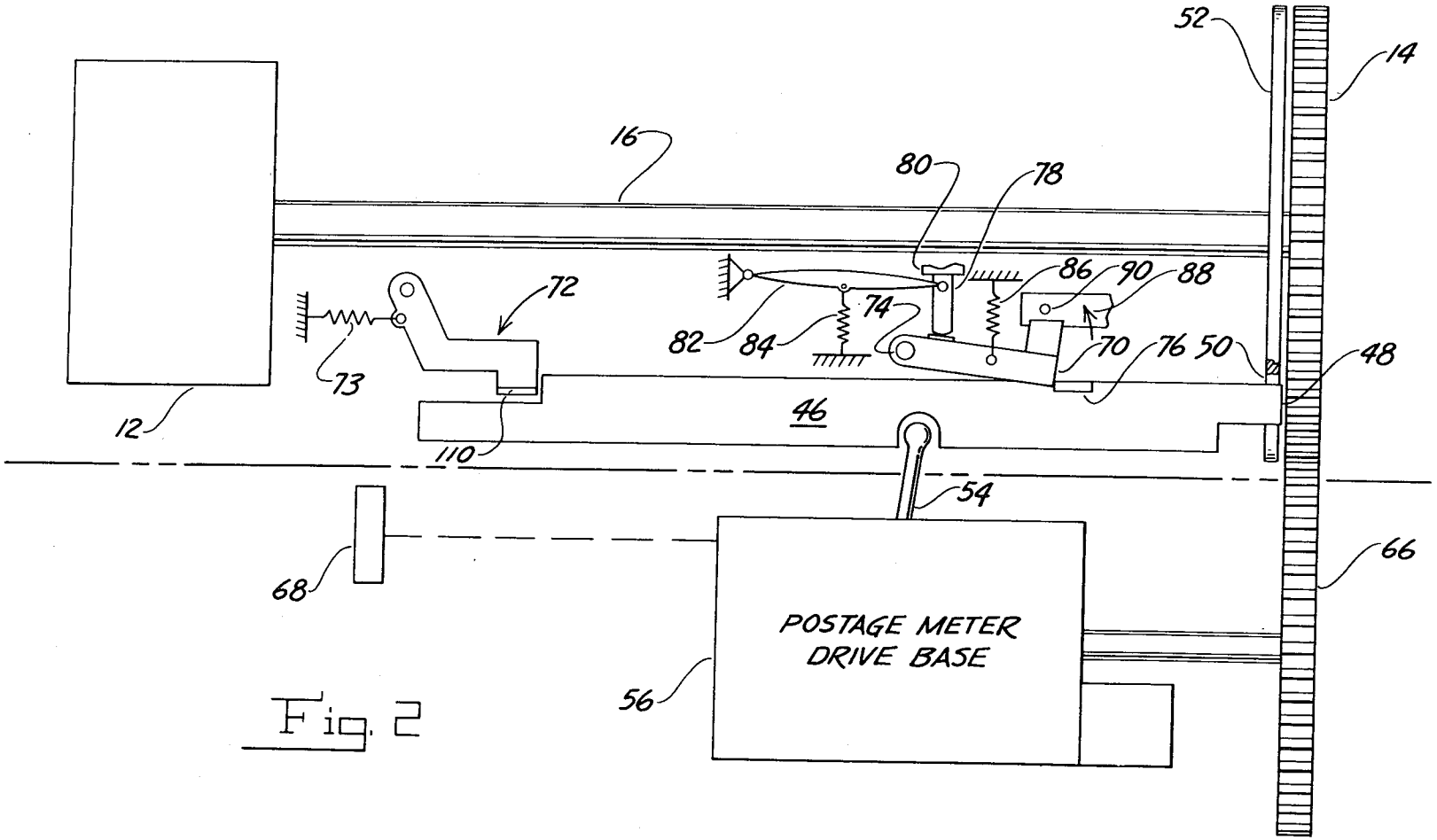
FIG. 2 is a left side view diagrammatic representation of the postage meter shown in FIG. 1 in operative engagement with a postage meter drive base.

A shutter bar 46 is slidably mounted within the postage meter 10 into and out of a position to inhibit or block rotation of postage meter drive gear 14. In the blocking position, as shown in FIGS. 1 and 2, the tail 48 of the shutter bar projects through a slot 50 in a plate 52 which is spaced apart but securely fastened to postage meter drive gear 14. The shutter bar tail 48 projects through the slot into the space between plate 52 and the drive gear 14. In this position, the postage meter drive gear 14 is blocked or inhibited from rotating the print drum 12 to print postage or other information on a mail piece.

The shutter bar 46 is movable by a shutter bar lever 54 into and out of the blocking position. The shutter bar lever 54 is part of a postage meter drive base 56 to which the postage meter 10 is detachably mounted. The shutter bar lever 54 projects through an opening in the bottom 58 of the postage meter frame to nest in a notch 60 in the shutter bar. If the postage meter interposer 70 and postage meter interposer 72 are positioned out of the locking position where they hold the shutter bar 46 in its print inhibiting position, the shutter bar 46 may be moved to unblock the postage drive gear 14 so that it may be rotated.

As is shown in FIG. 2, the postage meter drive base 56 includes a drive gear 66 which is adapted to engage and drive postage meter drive gear 14. Upon initiation of a printing cycle by tripping a postage meter drive base trip mechanism 68, shutter bar lever 54 is driven by the postage meter drive base to move in a direction which would move the shutter bar from the blocking to the non-blocking position. The postage meter base may be of the type disclosed in U.S. Pat. No. 2,934,009 for Sheet Feeding and Treating. In this type base, if the shutter bar 46 is locked against movement, the shutter bar lever will not engage a clutch in the drive base. As a result, power will not be applied to rotate the base drive gear 66. This prevents jamming when the shutter bar is locked into position to block rotation of the postage meter drive gear and the base is tripped to initiate a printing cycle.

Movement of the shutter bar lever 54 to move the shutter bar out of its blocking position can only occur if interposer 70 and interposer 72 are moved out of the locking position shown in FIGS. 1, 2, 3 and 4. After the shutter bar 46 is positioned in its non-blocking position, the base drive gear 66 can commence rotation to drive postage meter drive gear 14. Following the completion of a print cycle, the shutter bar 46 is moved back to its blocking position by shutter bar lever 54 and the interposers 70 and 72 may be moved to the locking position. A latch (not shown) may be provided to insure that the postage meter cannot be cycled again without the shutter bar being cycled as described in U.S. patent application entitled Postage Meter Improvement, Ser. No. 024,812, filed Mar. 28, 1979 for Robert B. McFiggans and Alton B. Eckert. The interposer 70 is pivoted at one end for rotation about pivot 74 to engage a shoulder 76 secured to the shutter bar 46. The interposer is held in the blocking position by means of the force exerted downwardly on the plunger 78 of a solenoid 80, when non-energized, by spring biased lever 82. The force of spring 84 is sufficient to overcome the opposing force of a relatively light spring 86.

When solenoid 80 is energized, the plunger 78 is retracted and interposer 70 is rotated in the direction of arrow 88 under the force of spring 86. The interposer 70 will rotate until it engages a stop 90. In this position, the interposer 70 is moved out of its blocking position with shutter bar 76. The arrangement of the interposer 70 and its associated components is disclosed in U.S. patent application, Ser. No. 024,812, filed Mar. 28, 1979 for Robert B. McFiggans and Alton B. Eckert and entitled Postage Meter Improvement. The interposer 72 is independently controlled by the rotation of the master gear 30 when engaged with a partial gear 92 laterally spaced from gears **28*a* and 28*b*. Partial gear 92 is rotatably mounted on a shaft 93 which is concentric with the shafts 26*a* and 26*b***.

The laterally movable carriage 32 can be positioned to selectively engage either the gears **28*a* and 28*b*, as well as corresponding gears, not shown associated with rack drive gears 24*a* and 24*b*, or partial gear 92. Tooth profiles 94*a* and 94*b*, best shown in FIGS. 3–6, are provided to engage and prevent gears 28*a* and 28*b* from rotating when they are not engaged with master gear 30. Similarly, when partial gear 92 is not engaged with master gear 30, toothed profiles 94*a* or 94*b* may engage partial gear 92 to prevent rotation. Similar tooth profiles may be provided on the lower portion, not shown, of the laterally movable carriage 32 to lock the other gear associated with positioning the racks in the printing drum shaft 16** against rotation.

Partial gear 92 is rigidly connected for simultaneous movement to a cam lock member 96. Partial gear 92 is connected by a link 98 to a bail or bell crank 100 rotatably mounted to shaft 102. Bell crank 100 is driven to rotate by the link 98 which is in turn controlled by partial gear 92. Link 98 is movably captured in an arcuate slot 104 in partial gear 92. The arcuate slot enables the cam lock member 96 to be rotated without corresponding movement of the interposer 72. Interposer 72 may be biased by a spring 73, shown only in FIG. 2, to be biased to rotate toward its locking position. Thus, when the arcuate slot 104 is not positioned to have its slot ends bear against link end 106, the interposer 72 will be biased toward its blocking position.

Figure 3:
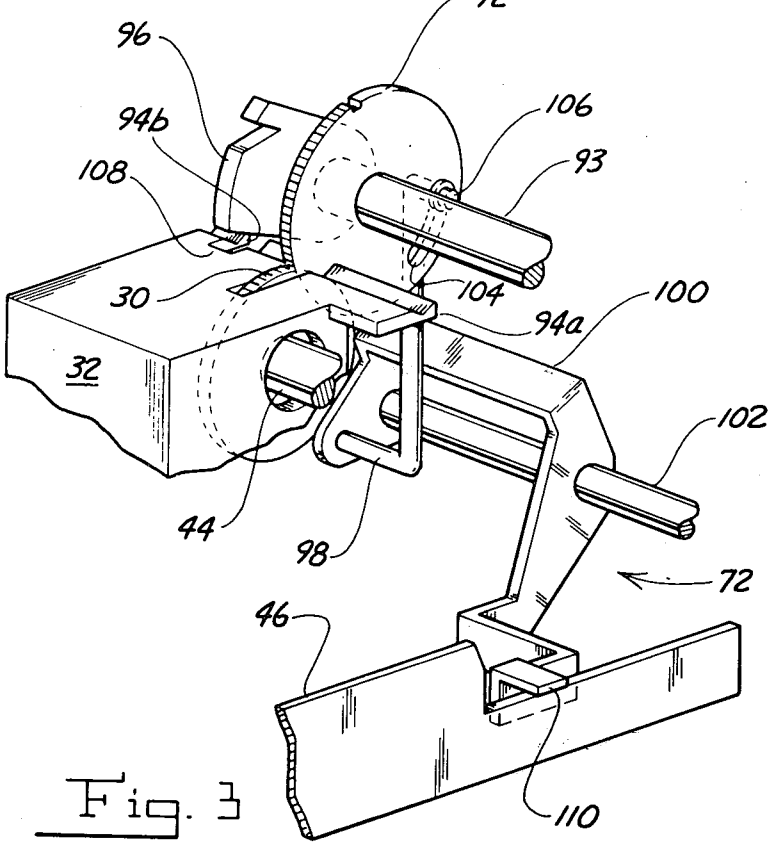

Referring now to FIG. 3, the cam lock member 96 is shown positioned by the partial gear 92 to be disengaged with a cam locking slot 108. The bell crank 100 is positioned so that an extension 110 locks the shutter bar 46 in its blocking position. In this position, laterally movable carriage 32 is free to be shifted to selectively engage gears **28*a* and 28*b*. Carriage 32 is free to be moved, but extension 110 locks the shutter bar 46 in a position blocking or inhibiting the energization of the print drum 12 by rotation of the postage meter drive gear 14. If the carriage 32 is moved toward gears 28*a* and 28*b*, a cam lock interposer 33 will engage the groove 37 in cam lock member 96. The interposer 33 locks cam lock member 96 when the partial gear 92 is not engaged with master gear 30. This locks the cam lock member 96 and partial gear 92 in a position with the bell crank extention 110 locking the shutter bar 46** in its blocking position. The print character selection function is enabled and the printing function is inhibited.

Figure 4:
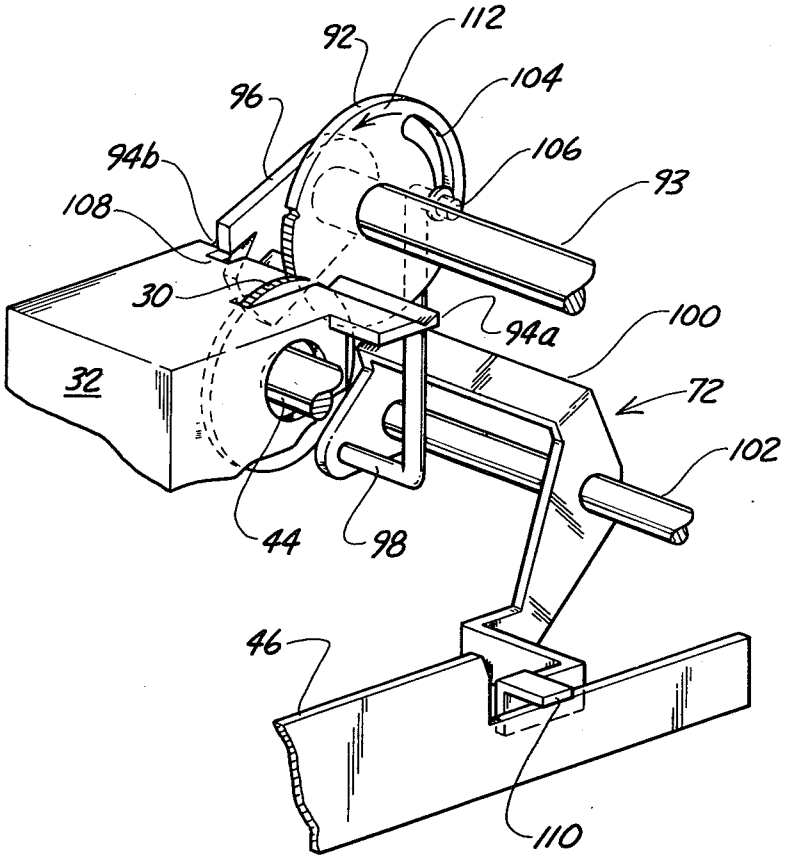
FIGS. 3–6 are enlarged partial perspective views of portions of the postage meter shown in FIG. 1 in various operative position helpful to a understanding of the present invention.

Referring now to FIG. 4, rotation of the partial gear 92 in the direction of the arrow 112 positions the cam lock 96 to engage the cam lock slot 108 on the carriage 32. This locks the carriage 32 from lateral movement and inhibits for movement the setting mechanism. In this position, the extension 110 of the bell crank 100 remains in its locking position. However, the link end 106 travels the length of the arcuate slot 104 and is positioned to begin to rotate bell crank 100 when partial gear 92 is further rotated in the direction of the arrow 112. Both the print character selection function and the printing functions are inhibited.

Figure 5:
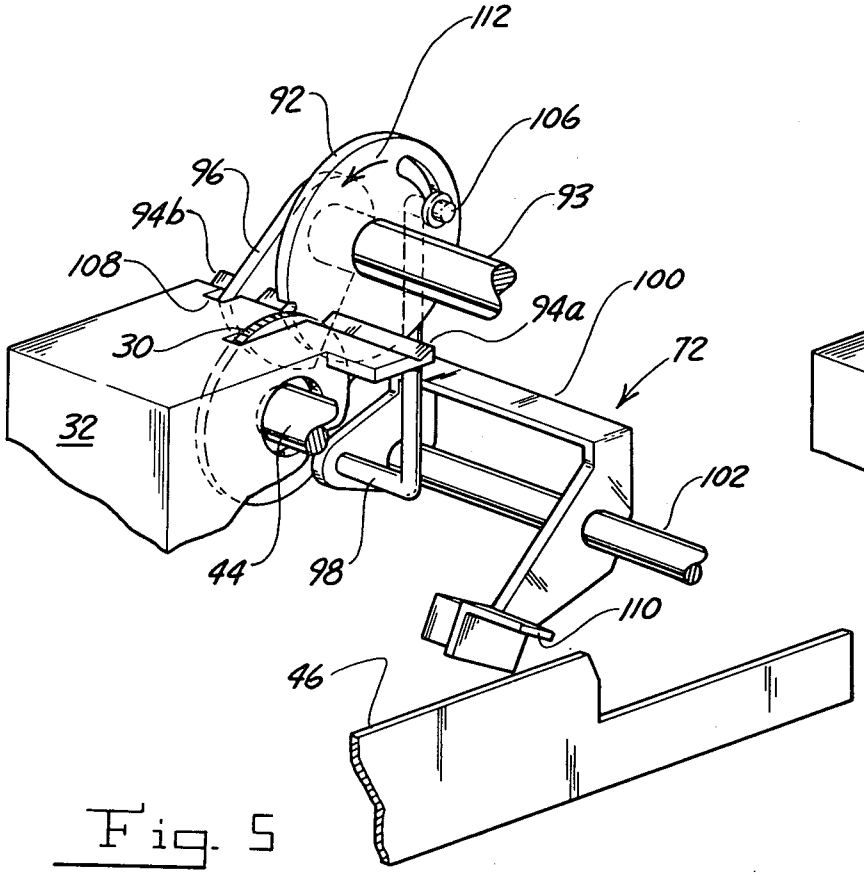

Reference is made to FIG. 5. In this position, the cam lock member 96 is further rotated into the cam lock slot 108. The carriage 32 continues to be locked against lateral movement. However, bell crank 100 is rotated under the action of the link 98 to position extension 110 out of the locking position with shutter bar 46. The shutter bar 46 is shown as having been displaced forward, which can occur only if the interposer 70 has also been moved out of its locking position. In the position shown in FIG. 5, the carriage 32 is locked against movement and the postage meter drive gear 14 is free to be energized by postage meter drive base gear 66 to cycle print drum 12 to print. The print character selection function is inhibited and the printing function is enabled.

Figure 6:
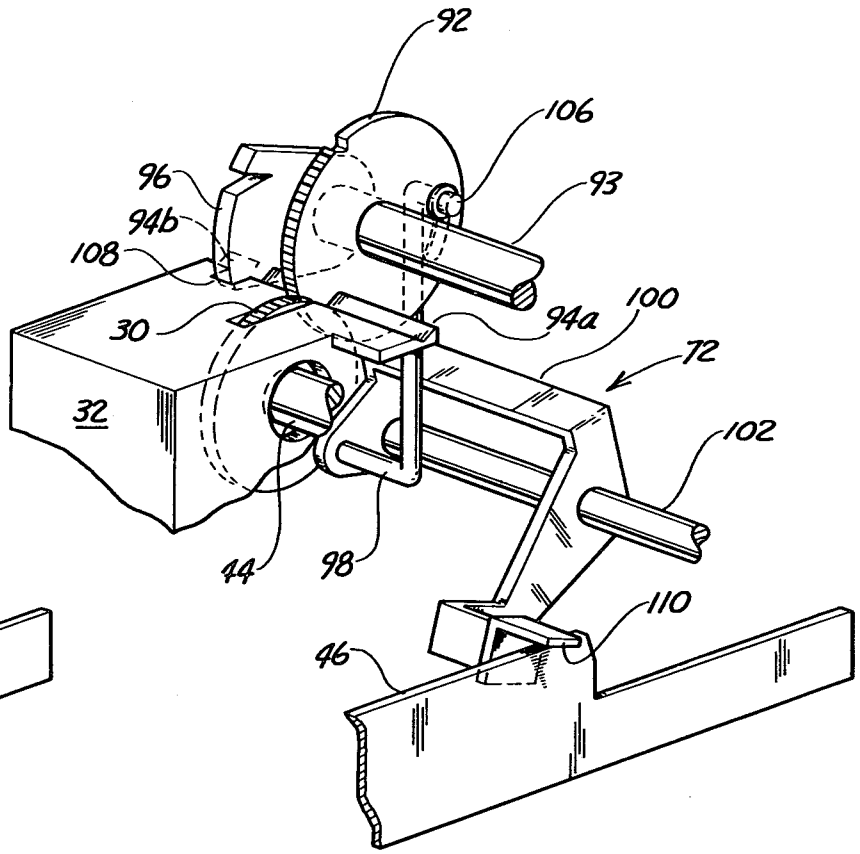

As shown in FIG. 6, if for any reason during the print enable condition the shutter bar has been moved to the non-blocking position, the partial gear 92 cannot be rotated enough to unlock the carriage 32. Rotating partial gear 92 in a direction to unlock the cam locking member 96 from the slot 108 is prevented by the interference of the bell crank extention 110 with the top surface of the shutter bar 46. As a consequence, the print character select function remains inhibited and the printing function remains enabled. If for any reason, such as a meter malfunction, it is desired to use interposer 110 to inhibit further printing even though the shutter is forward, the mechanism can be positioned as shown in FIG. 6, anticipating that when the shutter is restored (for example, after print cycle in progress), the interposer then will fall into a configuration similar to that shown in FIG. 4, under action of gravity and spring 73.

The master gear 30 controls and positively actuates by means of the mechanism including partial gear 92, link 98 and bell crank 100 inhibiting the print character select and the printing function. By controlling the rotation of the master gear 30, the functions of selecting postage and printing postage are mutually exclusive. Additionally, if the meter is detected as malfunctioning and the malfunction is deemed to be sufficiently serious, the master gear can be positioned to engage the partial gear and position the mechanism to lock up the meter. This would involve inhibiting both the print character select function and the printing function. Moreover, if the interposer 70 is detected as malfunctioning the meter can be blocked to inhibit the printing function by engaging master gear 30 with partial gear 92 and moving interposer 72 into its locking position.

What is claimed is:

1. A printing control system comprising:

means for printing postage having a plurality of separately settable print elements, said postage printing means settable to print a plurality of different postage amounts and adapted to be energized by a source of operating energy to print postage;

energizing means operably coupled to said postage printing means for energizing said printing means to print postage;

postage setting means including a gear rotatably mounted and movable to be selectively operably connected to each of said settable print elements of said postage printing means for changing the postage amount setting of said postage printing means to a selected postage amount of said plurality of different postage amounts;

a shutter means which can be moved into and out of a position to block said means energizing from energizing said postage printing means to print postage;

interposer means for holding said shutter means in said blocking position; and means adapted to be engaged by said postage setting means gear for moving said interposer means into and out of said position holding said shutter means in said blocking position.

2. In a system having a rotatable printing drum and means for rotating said drum and further having banks of print wheels which may be set to different positions through a gearing assembly including a number of a laterally spaced independently rotatable gears, a printing control system comprising:

a laterally movable carriage;

a master gear rotatably mounted within said carriage for engaging a single one of the independently rotatable gears at a time during which time the engaged independently rotatable gear can be rotated by the master gear;

a locking member;

a gear coupled to said locking member and laterally spaced from said independently rotatable gears and positioned to be engageable by said master gear;

a shutter means which can be extended into and block the path of movement of said means for rotating said printing drum;

a bell crank member including an extension, said bell crank movable to a position where said extension holds said shutter means in a blocking position and to another position where said extension is not holding said shutter bar in said blocking position;

linkage means for connecting said bell crank to said locking member gear; and said locking member gear is rotatable by said master gear to position said bell crank extension to hold said shutter means in said blocking position and said locking member disengaged to unlock said carriage for movement and is rotatable by said master gear to position said bell crank extension out of said position holding said shutter means in said blocking position and said locking member engaged to lock said carriage to prevent movement.

3. A printing control system as defined in claim 2 wherein said rotatable gear includes an arcuate slot and said linkage means is connected to said arcuate slot such that said bell crank and said locking member each move through different amounts of angular rotation when said master gear rotates said locking member gear.

4. A printing control system as defined in claim 2 including a locking member interposer engagable with said locking member when said locking member gear is rotated to cause said bell crank extension to hold said shutter means in said blocking positon.

5. A printing control system as defined in claim 2 wherein said movable carriage includes a slot adapted to receive said locking member when said locking member is rotated to engage said laterally movable carriage.

6. A print control system as defined in claim 2 including an interposer means controlled independent of said bell crank and movable into and out of a position to hold said shutter means in said blocking position.

7. A print control system as defined in claim 2 wherein said shutter means is a shutter bar.

8. In a system having a rotatably printing drum and means for rotating said drum and further having banks of print wheels which may be set to different positions through a gearing assembly including a number of a laterally spaced independently rotatable gears, a printing control system comprising:

a laterally movable carriage;

a master gear rotatably mounted within said carriage for engaging a single one of the independently rotatable gears at a time during which time the engaged independently rotatable gear can be rotated by the master gear;

a locking means;

a gear coupled to said locking means and laterally spaced from said independently rotatable gears and positioned to be engageable by said master gear;

a shutter means which can be extended into and block the path of movement of said means for rotating said printing drum;

means movable to a position to hold said shutter means in a blocking position and to another position where said movable means is not holding said shutter bar in said blocking position;

linkage means for connecting said movable means to said locking means gear; and said locking means gear (1) rotatable by said master gear to position said movable means to hold said shutter means in said blocking position and said locking member disengaged to unlock said carriage for movement, and (2) rotatable by said master gear to position said movable means out of said position holding said shutter means in said blocking position and said locking member engaged to lock said carriage to prevent movement.

* * * * *

UNITED STATES PATENT AND TRADEMARK OFFICE

CERTIFICATE OF CORRECTION

PATENT NO. : 4,287,825

DATED : September 8, 1981

INVENTOR(S) : Alton B. Eckert, Jr. et al.

It is certified that error appears in the above-identified patent and that said Letters Patent is hereby corrected as shown below:

The title page should be deleted to appear as per attached title page.

Column 5, line 38, "toothed" should read -- tooth --.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*

United States Patent [19]

Eckert, Jr. et al.

[11] 4,287,825

[45] Sep. 8, 1981

[54] PRINTING CONTROL SYSTEM

[75] Inventors: Alton B. Eckert, Jr., Norwalk; Richard A. Malin, Westport; Robert B. McFiggans, Stamford; Leonard M. Pengue, Huntington, all of Conn.

[73] Assignee: Pitney Bowes Inc., Stamford, Conn.

[21] Appl. No.: 89,412

[22] Filed: Oct. 30, 1979

[51] Int. Cl.[3] ..... B41J 1/22

[52] U.S. Cl. ..... 101/91; 101/45

[58] Field of Search ..... 101/45, 56, 91, 92, 101/235

[56] References Cited

U.S. PATENT DOCUMENTS

| | | | |
|---|---|---|---|
| 3,405,634 | 10/1968 | Maul et al. | 101/45 |
| 3,776,130 | 12/1973 | Tamiya | 101/45 |
| 3,823,666 | 7/1974 | Hanson | 101/91 |
| 3,881,411 | 5/1975 | Araki et al. | 101/45 |
| 3,965,815 | 6/1976 | Lupkas et al. | 101/91 |
| 3,983,802 | 10/1976 | Thomson et al. | 101/45 |
| 4,050,374 | 9/1977 | Check | 101/91 |
| 4,056,054 | 11/1977 | Feldman | 101/45 |
| 4,140,054 | 2/1979 | Martin et al. | 101/91 |

*Primary Examiner*—Edward M. Coven

*Attorney, Agent, or Firm*—David E. Pitchenik; Wm. D. Soltow, Jr.; Albert W. Scribner

[57] ABSTRACT

A printing control system includes a printing mechanism having settable print members. A gear is rotatably mounted and operably connected for selectively setting the print members. The gear is connected to control inhibiting the printing mechanism from being energized to print. The gear may also be connected to control inhibiting the selective setting of the print members.

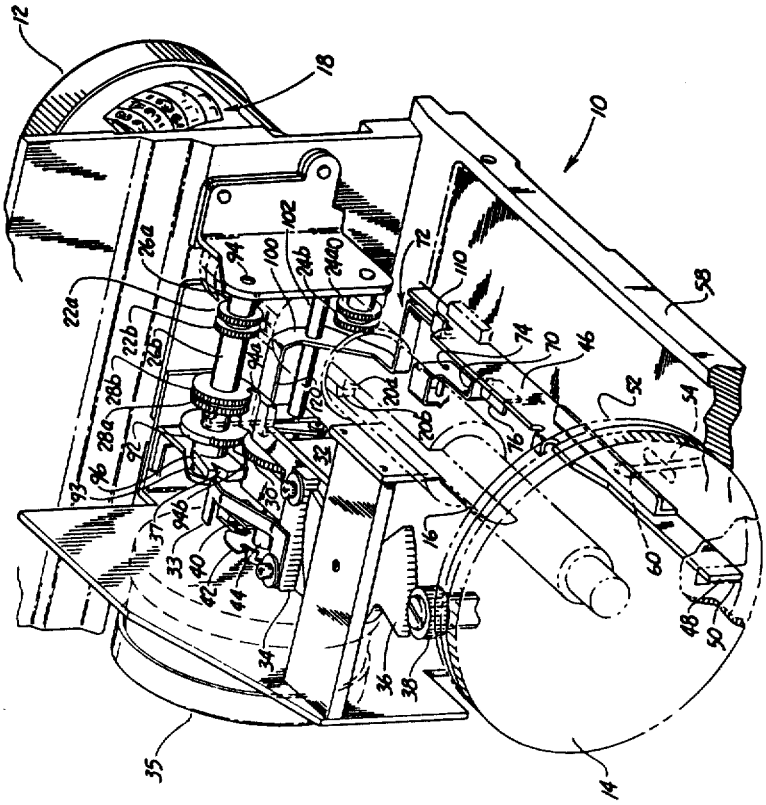

8 Claims, 6 Drawing Figures